US005980297A

United States Patent [19]

Sugie

[11] Patent Number: 5,980,297

[45] Date of Patent: Nov. 9, 1999

[54] LOCK ARM DEFORMATION PREVENTION CONSTRUCTION

[75] Inventor: Naoto Sugie, Shizuoka, Japan

[73] Assignee: Yazaki Corporation, Tokyo, Japan

[21] Appl. No.: 09/112,341

[22] Filed: Jul. 9, 1998

[30] Foreign Application Priority Data

Jul. 9, 1997 [JP] Japan ..... 9-183844

[51] Int. Cl.[6] ..... H01R 13/627

[52] U.S. Cl. ..... 439/354; 439/353

[58] Field of Search ..... 439/350–358

[56] References Cited

U.S. PATENT DOCUMENTS

| | | | |
|---|---|---|---|
| 5,246,380 | 9/1993 | Kodama | 439/354 |
| 5,554,044 | 9/1996 | Nishide | 439/352 |
| 5,624,272 | 4/1997 | Ohsumi | 439/357 |
| 5,785,546 | 7/1998 | Hamai et al. | 439/354 |

FOREIGN PATENT DOCUMENTS

| | | | |
|---|---|---|---|
| 2-20288 | 2/1990 | Japan | H01R 13/639 |

*Primary Examiner*—Hien Vu

*Attorney, Agent, or Firm*—Sughrue, Mion, Zinn, Macpeak & Seas, PLLC

[57] ABSTRACT

A lock arm deformation prevention construction for preventing the plastic deformation of an elastic lock arm so as to prevent a mutually-fitted condition of connectors from being affected. In the lock arm deformation prevention construction, a lock arm (3) is formed on a connector housing (2) of first connector (1), and displacement prevention piece portions (4) of an elastic nature are provided between the lock arm (3) and that surface of the connector housing (2) having the lock arm formed thereon, and abutment piece portions (6) are formed on a press portion (5), formed at an end portion of the lock arm (3), in an opposed relation respectively to the displacement prevention piece portions (4). Abutment cancellation ribs (7) for respectively displacing the displacement prevention piece portions (4) when the male and female connectors are fitted together are formed on a housing (9) of the second connector (8).

6 Claims, 4 Drawing Sheets

LOCK ARM DEFORMATION PREVENTION CONSTRUCTION

BACKGROUND OF THE INVENTION

1. Field of the Invention

This invention relates to a lock arm for locking the fitting connection between male and female connectors, and more particularly to a lock arm deformation prevention construction for preventing plastic deformation of the lock arm so as to prevent the incomplete locking of the fitting connection.

The present application is based on Japanese Patent Application No. Hei. 9-183844, which is incorporated herein by reference.

2. Description of the Related Art

FIG. 6 shows male and female connectors, in which a conventional lock arm is formed on the male connector. Female terminals 22 are retained in a housing 21 of the male connector 20 respectively by housing lances 33, and male terminals 25 are retained in a housing 24 of the female connector 23 respectively by housing lances 34. The male connector 20 is inserted into a tubular portion 32 formed at a front end of the female connector housing 24, so that the male terminals 25 are fitted into and electrically connected to the female terminals 22, respectively.

A lock arm 27, having an engagement projection 28, is formed on the male connector 20, and a flexing space 26 is formed on the lower side of the lock arm 27. A slit 30 for receiving the engagement projection 28 is formed in the tubular portion 32 of the female connector 23.

For fitting the male connector 20 into the female connector 23, the male connector 20 is inserted into the tubular portion 32 of the female connector 23 while pressing down a press portion 31 provided at a distal end of the lock arm 27, and when the engagement projection 28 is brought into a position where this projection 28 can fit into the slit 30, the application of a pressing force to the press portion 31 is stopped. As a result, the engagement projection 28 is fitted into the slit 30, and engages an engagement portion 29 formed at a front end of the slit 30, so that the two connectors are held in a mutually-fitted condition, and also each pair of male and female connection terminals are kept in an electrically-connected condition.

When it is desired to intentionally disconnect or disengage the male and female connectors, fitted together, from each other, the press portion 31 is pressed down, thereby disengaging the engagement projection 28 from the engagement portion 29, and in this condition the two connectors are moved away from each other.

However, if an external force F continues to act on the press portion 31 of the male connector 20, having the above lock arm, when the male connector 20 is in its independent condition, that is, not fitted in the female connector 23, and can be subjected to an external force from other parts, for example, during transport, this leads to the possibility that the lock arm 27 is plastically deformed.

If the lock arm 27 is plastically deformed, the engagement of the engagement projection 28 with the engagement portion 29 is incomplete as shown in FIG. 6 when the male connector 20 is fitted in the female connector 23, and even when the press portion 31 is not pressed down, the two connectors can be easily disengaged from each other upon application of an external force tending to move the two connectors away from each other. If such connectors are mounted, for example, on an automobile or the like, the mutually-engaged condition of the two connectors is canceled by vibrations developing during the running, so that each female terminal 22 is disconnected from the associated male terminal 25, thus breaking the electric circuit, which may cause a grave accident.

SUMMARY OF THE INVENTION

With the above problems in view, it is an object of this invention to provide a lock arm deformation prevention construction for preventing the plastic deformation of an elastic lock arm so as to prevent a mutually-fitted condition of connectors from being affected.

In order to achieve the above object, according to the first aspect of the present invention, there is provided a construction for preventing deformation of an elastic lock arm which comprises:

the elastic lock arm having a press portion formed at a free-end portion of the elastic lock arm;

a first connector having a surface on which the elastic lock arm is formed;

a second connector fittable to the first connector, wherein a fitting connection between the first and second connectors is retained with the elastic lock arm;

a displacement prevention piece portion having an elastic nature, the displacement prevention piece portion being provided between the surface of the first connector and the elastic lock arm;

an abutment piece portion formed on the press portion of the elastic lock arm, the abutment piece portion being opposite to the displacement prevention piece portion; and an abutment cancellation rib formed on the second connector, wherein when the first and second connectors are fitted to each other, the displacement prevention piece portion is displaced by the abutment cancellation rib.

In the above lock arm deformation prevention construction, even if an external force continues to act on the press portion at the distal end of the lock arm when the first connector is in its independent condition, that is, not fitted in the second connector, the elastic displacement prevention piece portions are abutted respectively with the abutment piece portions, thereby limiting the displacement of the lock arm, so that the deformation of the lock arm is kept within the elastic deformation range, and therefore the lock arm is prevented from being plastically deformed.

As the first connector is inserted into the second connector, the elastic displacement prevention piece portions are displaced respectively by the abutment cancellation ribs formed on the second connector, so that the displacement prevention piece portions will not abut against the abutment piece portions, respectively, and therefore the limitation of displacement of the lock arm is canceled. By further inserting the first connector into the second connector, the first connector, having the lock arm, can be properly fitted into the second connector. In the meantime, the elastic lock arm may be formed to be cantilevered on the surface of the first connector.

DETAILED DESCRIPTION OF THE PREFERRED EMBODIMENT

One preferred embodiment of a lock arm deformation prevention construction of the present invention will now be described in detail with reference to FIGS. 1 to 5.

Figure 1:
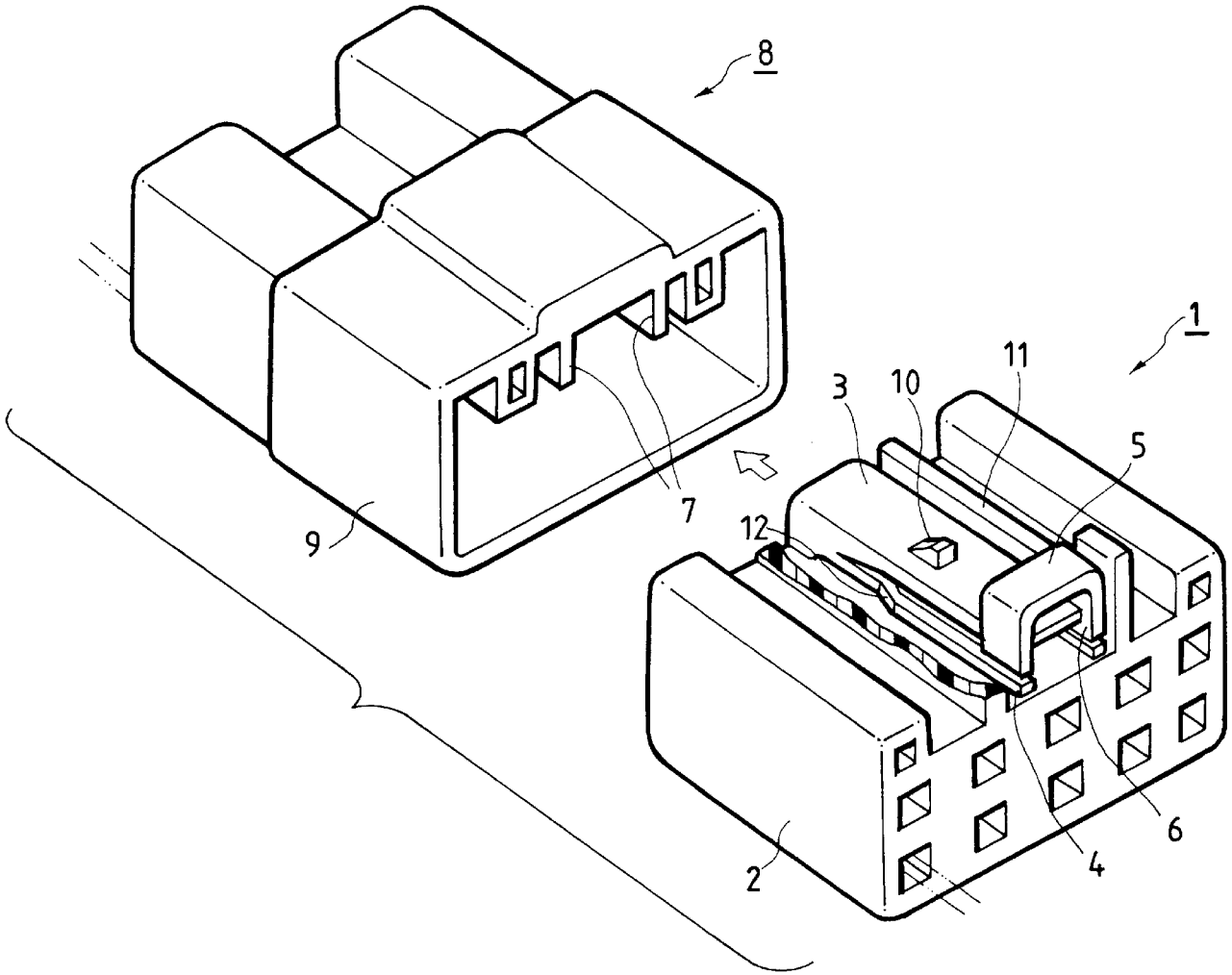
FIG. 1 is a perspective view showing a lock arm deformation prevention construction of the present invention in a partly-broken manner.
Figure 2:
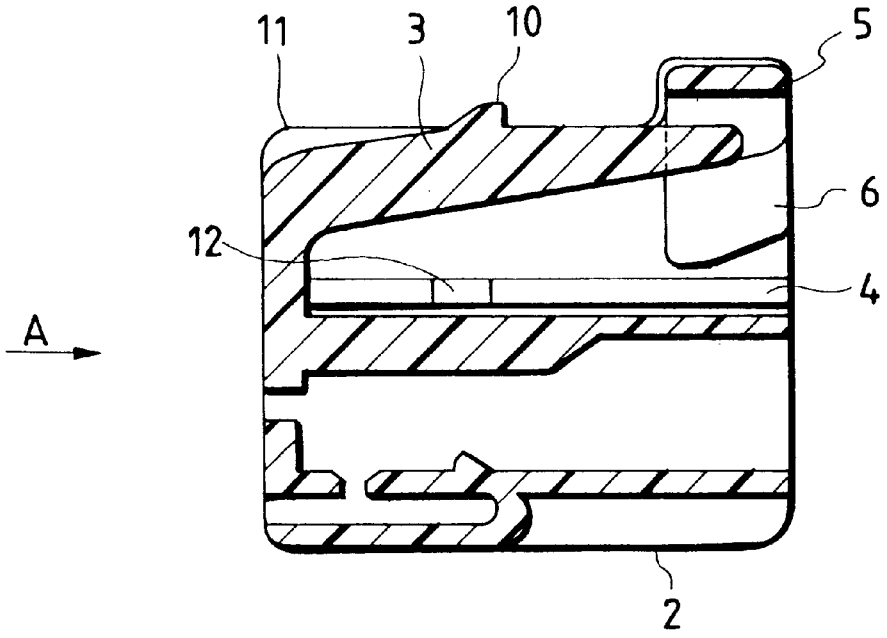
FIG. 2 is a vertical cross-sectional view of a male connector 1 in FIG. 1.
Figure 3:
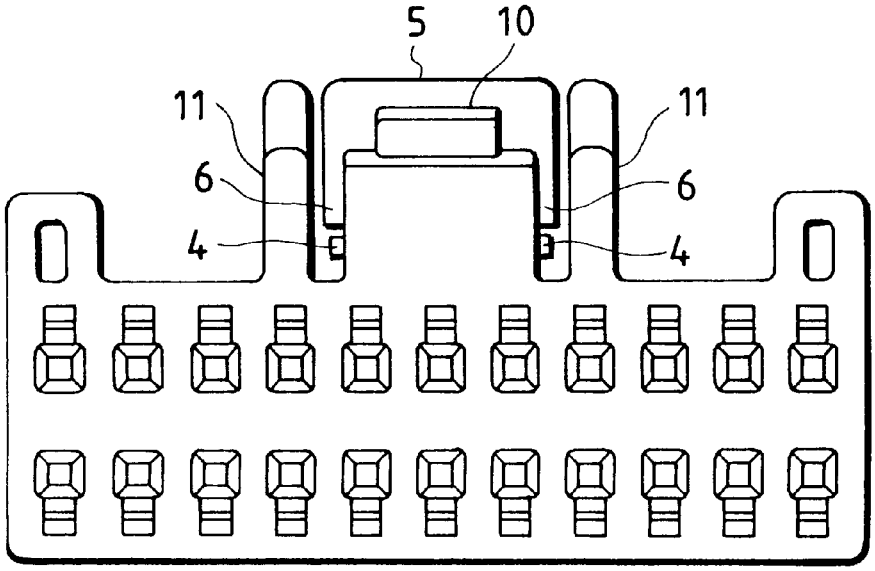
FIG. 3 is a view as seen in a direction of arrow A of FIG. 2.

As shown in FIGS. 1 to 3, the lock arm deformation prevention construction of this embodiment includes a pair of displacement prevention piece portions 4 of an elastic nature, which are formed between a cantilever-type lock arm 3, formed on the male connector 1, and a housing surface, and extend from the vicinity of a support portion of the lock arm 3 to the vicinity of a press portion 5, formed at a free end of the lock arm 3, along the housing surface, and are supported in a cantilever manner in the vicinity of the support portion of the lock arm 3, and a pair of abutment piece portions 6 formed on the press portion 5 of the lock arm 3 in opposed relation respectively to the displacement prevention piece portions 4.

A pair of abutment cancellation ribs 7 are formed within a housing 9 of the female connector 8, and these ribs 7 displace the displacement prevention piece portions 4, respectively, when the male connector 1 is inserted into the female connector 8. Each of the pair of displacement prevention piece portions 4 has an inwardly-slanting, bent portion 12, and as male connector 1 is inserted into the female connector 8, front ends of the abutment cancellation ribs 7 come into contact with and abut respectively against these bent portions 12 to inwardly flex the displacement prevention piece portions 4, respectively.

Figure 4:
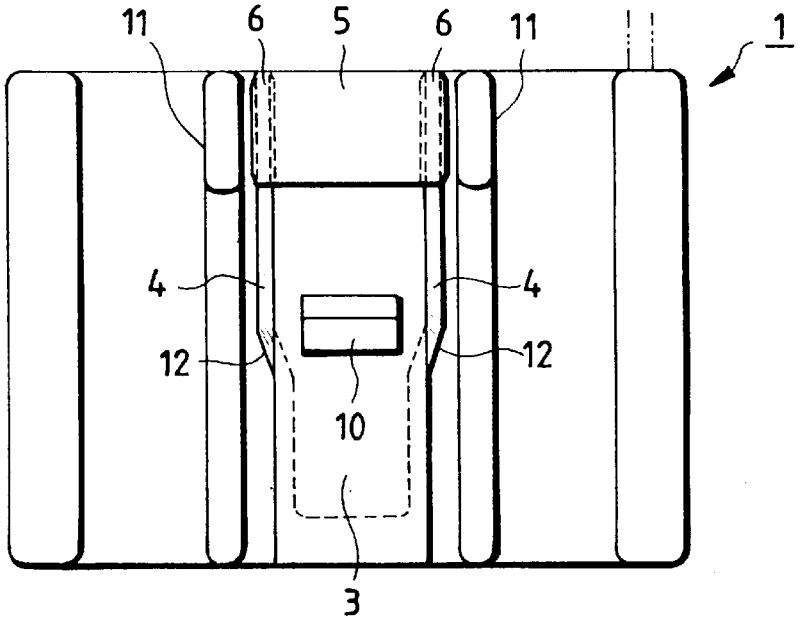
FIG. 4 is a plan view of the male connector 1 in FIG. 1.

As shown in FIG. 4, when the male connector 1, having the lock arm 3, is in its independent condition, that is, not fitted in the female connector, the rear portions of the displacement prevention piece portions 4 are disposed in opposed relation to the pair of abutment piece portions 6 (seen as in superimposed relation in FIG. 4), respectively. In this condition, even if an external force continues to act on the press portion 5, the pair of abutment piece portions 6 abut respectively against the displacement prevention piece portions 4, thereby limiting the displacement of the lock arm 3, and therefore the lock arm 3 is kept within an elastic deformation range, and is prevented from being plastically deformed.

Figure 5:
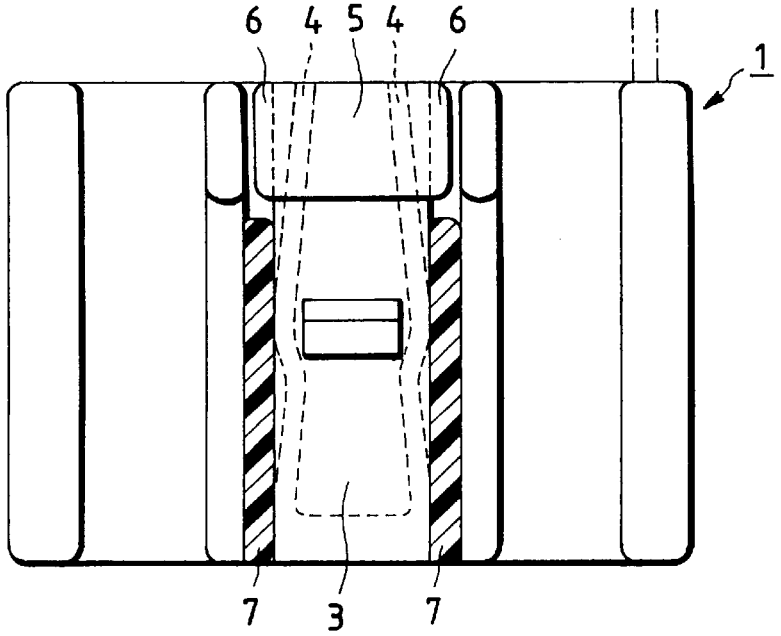
FIG. 5 is a plan view of the male connector 1 fitted in a female connector 8 in FIG. 1.
Figure 6:
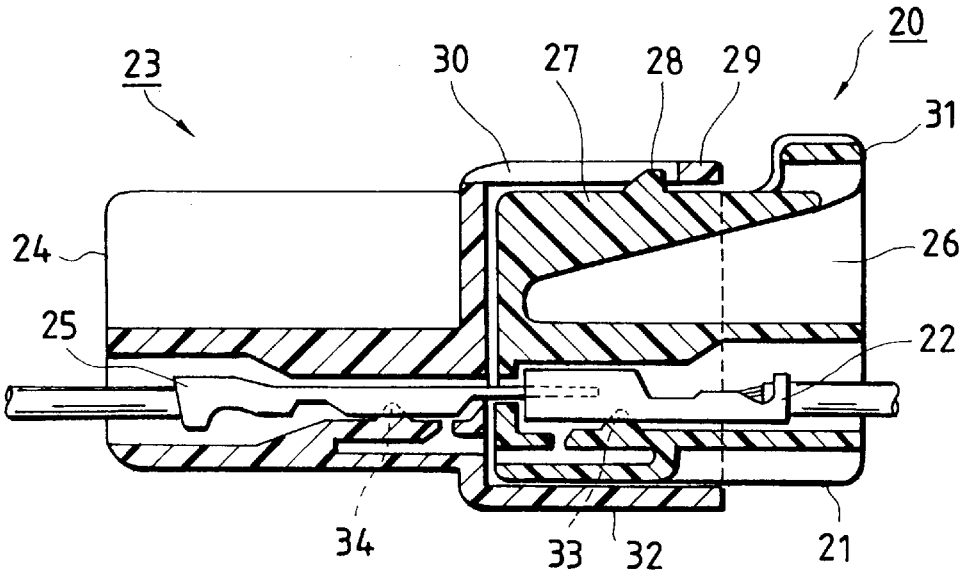
FIG.6 PRIOR ART
FIG. 6 is a vertical cross-sectional view showing male and female connectors having a conventional lock arm.
Figure 7:
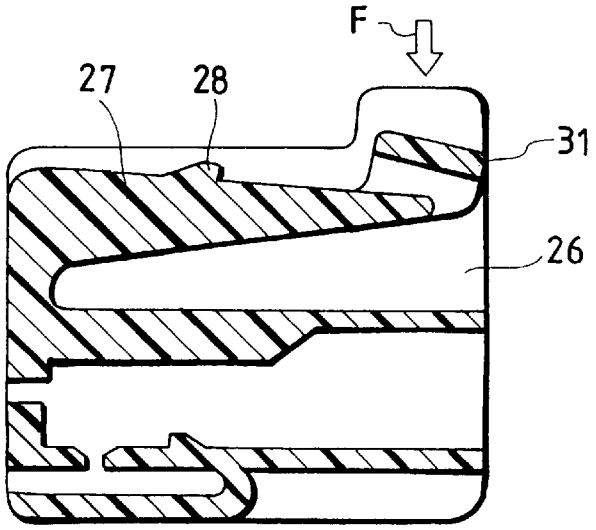
FIG.7 PRIOR ART
FIG. 7 is a view showing the plastic deformation of a lock arm 27 of a male connector 20 in FIG. 6.

As shown in FIG. 5, as the male connector 1 is inserted into the female connector, the front ends of the abutment cancellation ribs 7, formed within the female connector, first abut respectively against the inwardly-slanting bent portions 12 of the displacement prevention piece portions 4, and then when the male connector 1 is further inserted into the female connector, the abutment cancellation ribs 7 inwardly flex the elastic displacement prevention piece portions 4, respectively. This inward flexing of the displacement prevention piece portions 4, particularly the rear portions thereof is such that, the displacement prevention piece portions 4 will not abut respectively against the pair of abutment piece portions 6 when the press portion 5 is pressed. Thus, the limitation of displacement of the lock arm 3 is canceled. By further inserting the male connector 1 into the female connector 8, the male connector can be properly fitted into the female connector.

In this condition, the press portion 5 can be pressed down as is the case with the male and female connectors having the conventional lock arm, and the male connector can be intentionally connected to and disconnected from the female connector 8. When the two connectors are fitted together, an engagement projection 10 is engaged in an engagement portion (not shown) in the female connector 8, and therefore the mutually-fitted condition of the two connectors will not be. separated by an external force tending to move the two connectors away from each other.

When an external force acts on the press portion 5 in the mutually-fitted condition of the male and female connectors, the press portion 5 can be pressed down, and it is possible to then disengage male connector 1 from female connector 8. Therefore, a pair of protection walls 11 for preventing an external force from acting directly on the press portion 5 are formed upright on the male connector 1, and are disposed on the opposite sides of the lock arm 3, respectively.

In the above lock arm deformation prevention construction of this embodiment, the pair of elastic displacement prevention piece portions 4 are provided between that surface of the male connector 1, having the lock arm 3 formed thereon, and the lock arm 3, and the pair of abutment piece portions 6 are formed on the press portion 5, formed at the distal end of the lock arm 3, in opposed relation respectively to the displacement prevention piece portions 4.

Therefore, even if an external force continues to act on the press portion 5 when the male connector 1, having the lock arm 3, is in its independent condition, that is, not fitted in the female connector 8, the elastic displacement prevention piece portions 4 are abutted respectively with the abutment piece portions 6, thereby limiting the displacement of the lock arm, so that the deformation of the lock arm 3 is kept within the elastic deformation range, and therefore the lock arm 3 is prevented from being plastically deformed.

The lock arm deformation prevention construction of the present invention is not limited by the above embodiment, and various modifications can be made. For example, the displacement prevention piece portions 4 do not always need to be supported in a cantilever manner in the vicinity of the support portion of the lock arm 3, but may be formed on the upper surface of the male connector housing. The inwardly-slanting bent portions of the displacement prevention piece portions may be replaced by curved portions, respectively.

As described above, in the lock arm deformation prevention construction of the present invention, the displacement prevention piece portions of an elastic nature are provided between that surface of the connector housing of one of the two connectors, having the lock arm formed thereon, and the lock arm, and the abutment piece portions are formed on the press portion, formed at the end portion of the lock arm, in opposed relation respectively to the displacement prevention piece portions, and the abutment cancellation ribs for respectively displacing the displacement prevention piece portions when the male and female connectors are fitted together are formed on the housing of the second connector.

Therefore, even if an external force continues to act on the press portion at the distal end of the lock arm when the first connector, having the lock arm, is in its independent condition, that is, not fitted in the second connector, the elastic displacement prevention piece portions are abutted respectively with the abutment piece portions, thereby limiting the displacement of the lock arm, so that the deformation of the lock arm is kept within the elastic deformation range, and therefore the lock arm is prevented from being plastically deformed.

As the first connector, having the lock arm, is inserted into the second connector, the elastic displacement prevention piece portions are displaced respectively by the abutment cancellation ribs formed on the second connector, so that the displacement prevention piece portions will not abut against the abutment piece portions, respectively, and therefore the limitation of displacement of the lock arm is canceled. Therefore, by pressing down the press portion at the distal end of the lock arm, the first connector, having the lock arm, can be fitted into the second connector as is the case with the connectors having the conventional lock arm.

What is claimed is:

1. A connector arrangement, comprising:

a first connector including:

an elastic lock arm extending therefrom so as to define a space between said elastic lock arm and an outer surface of said first connector, an elastic displacement prevention piece portion positioned in said space between said outer surface of said first connector and said elastic lock arm, and an abutment piece portion formed on said elastic lock arm, said abutment piece portion being opposite to said displacement prevention piece portion; and a second connector mateable with said first connector and including an abutment cancellation rib formed thereon, wherein when said first and second connectors are in an unfitted condition, said displacement prevention piece portion and said abutment piece portion cooperate to prevent excessive deflection of said elastic lock arm, and wherein when said first and second connectors are fitted to each other, said abutment cancellation rib abuts against said displacement prevention piece portion and displaces said displacement prevention piece portion to allow deflection of said elastic lock arm.

2. The connector arrangement of claim 1, wherein said elastic lock arm is cantilevered from said outer surface of said first connector.

3. The connector arrangement of claim 2, wherein said displacement prevention piece portion is provided between said outer surface of said first connector and a free-end portion of said elastic lock arm.

4. The connector arrangement of claim 1, wherein said abutment piece portion is formed on a press portion of said elastic lock arm.

5. The connector arrangement of claim 1, wherein said first connector includes a pair of elastic displacement prevention piece portions positioned in said space between said outer surface of said first connector and said elastic lock arm, and a corresponding pair of abutment piece portions formed on said elastic lock arm, said abutment piece portions being opposite to said displacement prevention piece portions, respectively.

6. The connector arrangement of claim 5, wherein said abutment piece portion is formed on a press portion of said elastic lock arm.

* * * * *